US009295330B1

(12) United States Patent
Kler Da Silva

(10) Patent No.: US 9,295,330 B1
(45) Date of Patent: Mar. 29, 2016

(54) DRAWER SLIDER

(71) Applicant: METALÚRGICA ALBRAS LTDA., Embú (BR)

(72) Inventor: Nilson Kler Da Silva, São Paulo (BR)

(73) Assignee: METALURGICA ALBRAS LTDA., Embu, SP (BR)

( * ) Notice: Subject to any disclaimer, the term of this patent is extended or adjusted under 35 U.S.C. 154(b) by 0 days.

(21) Appl. No.: 14/605,633

(22) Filed: Jan. 26, 2015

Related U.S. Application Data

(60) Provisional application No. 62/049,676, filed on Sep. 12, 2014.

(51) Int. Cl.

| | |
|---|---|
| ***A47B 88/04*** | (2006.01) |
| ***A47B 88/16*** | (2006.01) |
| ***A47B 88/08*** | (2006.01) |
| ***A47B 88/12*** | (2006.01) |

(52) U.S. Cl.
CPC ..... *A47B 88/16* (2013.01); *A47B 88/08* (2013.01); *A47B 88/12* (2013.01)

(58) Field of Classification Search
CPC ..... A47B 88/04; A47B 88/08; A47B 88/16; A47B 88/12
USPC ..... 312/333, 334.1
See application file for complete search history.

(56) References Cited

U.S. PATENT DOCUMENTS

| | | | | |
|---|---|---|---|---|
| 5,484,209 | A * | 1/1996 | Weng | 384/18 |
| 6,435,636 | B1 * | 8/2002 | MacMillan | 312/334.46 |
| 2002/0057042 | A1 * | 5/2002 | Milligan | 312/334.46 |
| 2005/0269922 | A1 * | 12/2005 | Lai | 312/334.46 |
| 2006/0028104 | A1 * | 2/2006 | Tseng et al. | 312/334.44 |
| 2007/0001562 | A1 * | 1/2007 | Park | 312/333 |
| 2008/0122333 | A1 * | 5/2008 | Tseng et al. | 312/333 |
| 2008/0141496 | A1 * | 6/2008 | Peng et al. | 16/94 R |
| 2012/0201484 | A1 * | 8/2012 | Chen et al. | 384/21 |
| 2014/0072248 | A1 * | 3/2014 | Chen et al. | 384/20 |
| 2014/0265792 | A1 * | 9/2014 | Chiu | 312/334.44 |
| 2014/0327352 | A1 * | 11/2014 | Chen et al. | 312/334.46 |

* cited by examiner

*Primary Examiner* — Daniel Rohrhoff
(74) *Attorney, Agent, or Firm* — K&L Gates LLP

(57) ABSTRACT

The present disclosure relates generally to a novel drawer slider structure for sliding systems. More specifically, the present disclosure relates to a drawer slider providing substantial material savings for its manufacturing, and providing a larger opening extension with respect to known drawer sliders. In an embodiment, the drawer slider includes a first fixed outer rail and at least one second inner rail mounted on the outer rail that can slide longitudinally along the outer rail. The outer rail includes a bumper provided on or near an edge of the outer rail taken across a longitudinal plane of the outer rail. The inner rail includes a stroke limiter along a longitudinal section of the inner rail that is configured to cooperate with the bumper.

20 Claims, 17 Drawing Sheets

DRAWER SLIDER

PRIORITY CLAIM

This application claims the benefit of U.S. provisional patent application No. 62/049,676 filed on Sep. 12, 2014, the entire disclosure of which is incorporated by reference herein.

TECHNICAL FIELD

The present disclosure relates generally to a new drawer slider structure for sliding systems. More specifically, the present disclosure relates to a drawer slider providing substantial material savings for its manufacturing, in addition to providing a larger opening extension than known sliders.

BACKGROUND ART

Drawer sliders are widely used in sliding systems, such as, for example, drawers, chests of drawers, filing cabinets, etc., that is, any system requiring a sliding function of an object.

These drawer sliders are generally include a first rail that is attached to a wall and a second rail that is attached to the object to be slid, such as a drawer. The first rail slides along the second rail.

Telescopic drawer sliders are also known, where generally two or three rails are mounted one inside of the other, to allow a longer length of opening.

Some manufacturers have verified that the material costs for manufacturing currently-existing drawer sliders can be up to 60% of the finished product cost, that is, practically ⅔ of the total cost of the product. Therefore, it is desirable to reduce the amount of material used in the manufacturing of a drawer slider to reduce the total cost of the finished product.

One objective of the disclosure is to provide a drawer slider which uses less material than known sliders, without compromising the safety or the extension of drawer slider opening.

Another objective of the disclosure is to provide a drawer slider, specifically a telescopic slider comprising two or three rails, employing less material for its manufacturing, without compromising the product length of opening and/or performance.

SUMMARY

The present disclosure relates to a drawer slider providing substantial material savings for its manufacturing, in addition to providing a larger opening extension than known sliders. In a general embodiment, a drawer slider includes at least an external first outer rail to be attached to a wall of a chest of drawers or a filing cabinet, and at least a second inner rail mounted on the first outer rail that can slide longitudinally along the external rail, wherein the external rail includes a bumper provided on one of its sides and the inner rail includes a stroke limiter provided along its longitudinal section to cooperate with the bumper.

In another general embodiment, a drawer slider includes a first fixed outer rail, and at least a second inner rail mounted on the first outer rail that can slide longitudinally along the outer rail, wherein the inner rail includes a bumper provided in a close region to or in one of its edges taken along its longitudinal plane, and wherein the inner rail includes a stroke limiter provided along its longitudinal section to cooperate with the bumper.

In another embodiment, the drawer slider additionally includes a third middle rail mounted on the outer rail that can slide longitudinally along the outer rail, and the inner rail is mounted on the middle rail and can slide longitudinally along the middle rail.

In another embodiment, the drawer slider is made of a metallic material.

In another embodiment, the metallic material is carbon steel.

In another embodiment, the stroke limiter includes a fold placed along the longitudinal section of the inner rail that is intended to cooperate with the bumper.

In another embodiment, the stroke limiter includes a fold placed along the longitudinal section of the outer rail that is intended to cooperate with the bumper.

In another embodiment, the stroke limiter includes a pin placed along the longitudinal section of said inner rail that is intended to cooperate with said bumper.

In another embodiment, the stroke limiter is provided in a defined portion in a spot along the half of the plane taken with respect to the longitudinal length of the inner rail.

In another embodiment, the stroke limiter additionally includes a mechanism to avoid accidental sliding of the drawer slider.

In another embodiment, the mechanism to avoid accidental sliding of the drawer slider is a punch that is configured cooperate with the stroke limiter.

In another embodiment, the stroke limiter is provided in a clamp mounted on the inner rail.

In another embodiment, the stroke limiter provided in the clamp is a first projection configured to cooperate with the bumper.

In another embodiment, the stroke limiter includes a mechanism to avoid accidental sliding of the drawer slider.

In another embodiment, the mechanism to avoid accidental sliding is a second projection configured to cooperate with the bumper.

In another embodiment, the stroke limiter includes an impact absorption mechanism.

In another embodiment, the impact absorption mechanism is made of an elastomeric material.

In another general embodiment, a drawer slider includes a first fixed outer rail, and at least a second inner rail mounted on the outer rail that can slide longitudinally along the outer rail, wherein the inner rail includes a length taken along its longitudinal section which is longer than the length of the outer rail.

In another embodiment, the drawer slider can include a third middle rail mounted on the outer rail that can slide longitudinally along the outer rail, and the inner rail is mounted on the middle rail and can move longitudinally along the middle rail, wherein the inner rail has a length, taken along its longitudinal section, longer than the length of outer and middle rails.

BRIEF DESCRIPTION OF THE DRAWINGS

Embodiments of the present disclosure will now be explained in further detail by way of example only with reference to the accompanying figures, in which.

DETAILED DESCRIPTION

The present disclosure will now be described with respect to particular embodiments, referring to the accompanying figures. The specific embodiments are described in detail and shown in the figures, with the understanding that they shall be considered an exemplification of the principles of the present disclosure, and are not meant to limit the disclosure only to what is shown and described. It shall be recognized that different teachings of the below-described embodiments may be employed separately or in any suitable combination to produce the same technical effects. The reference signs are repeated in the figures for the same technical characteristics, and some constructive details already known in the state of the art have been omitted in the figures and in the following description for clarity purposes.

Figure 1:
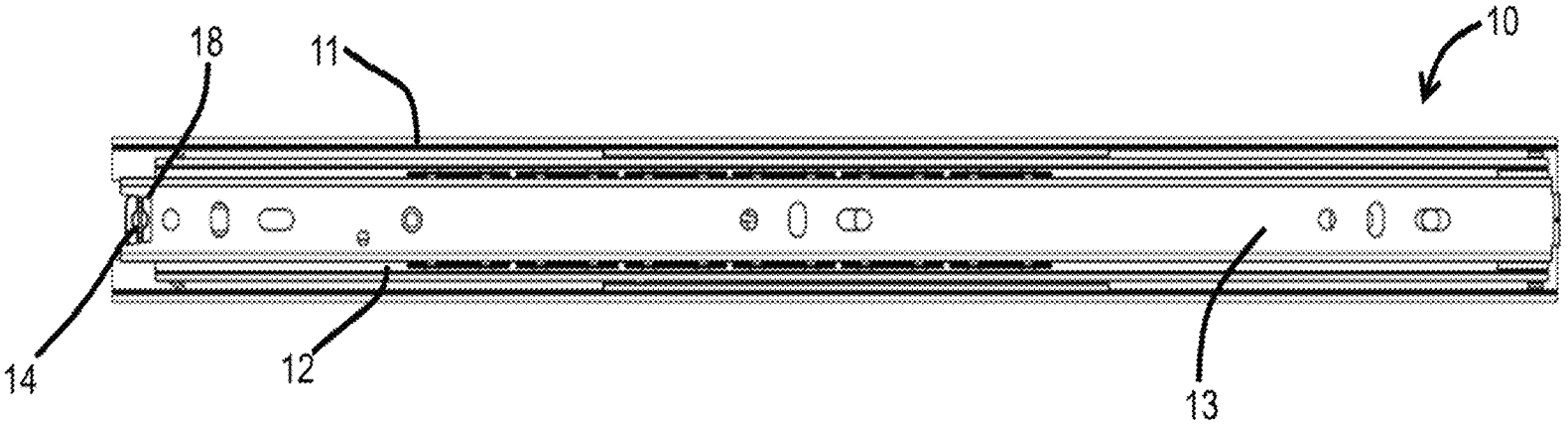
Fig. 1 (Prior Art)
FIG. 1 shows a front view of a drawer slider, specifically a state of the art telescopic drawer slider of three rails, in a retracted position.
Figure 2:
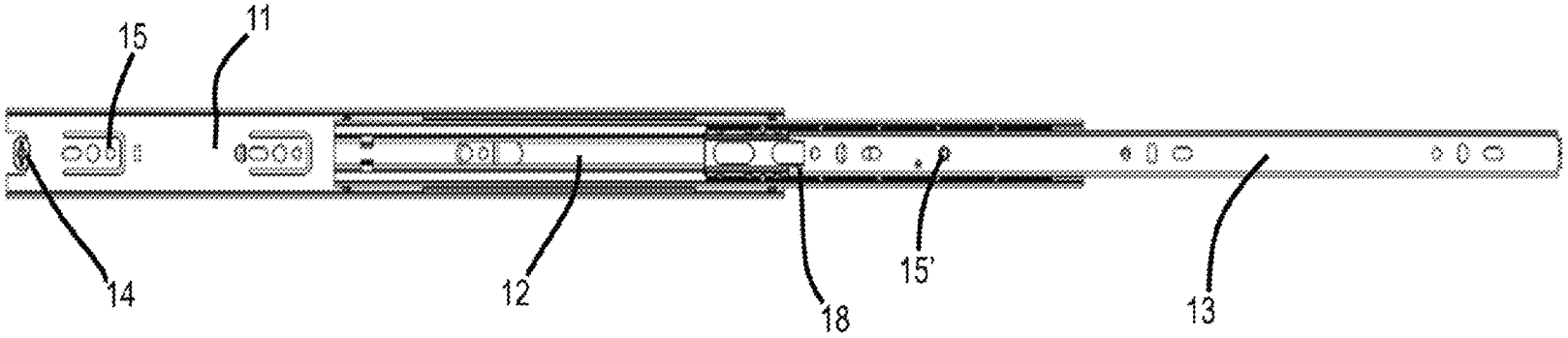
Fig. 2 (Prior Art)
FIG. 2 shows the drawer slider of FIG. 1 in an extended position.
Figure 3:
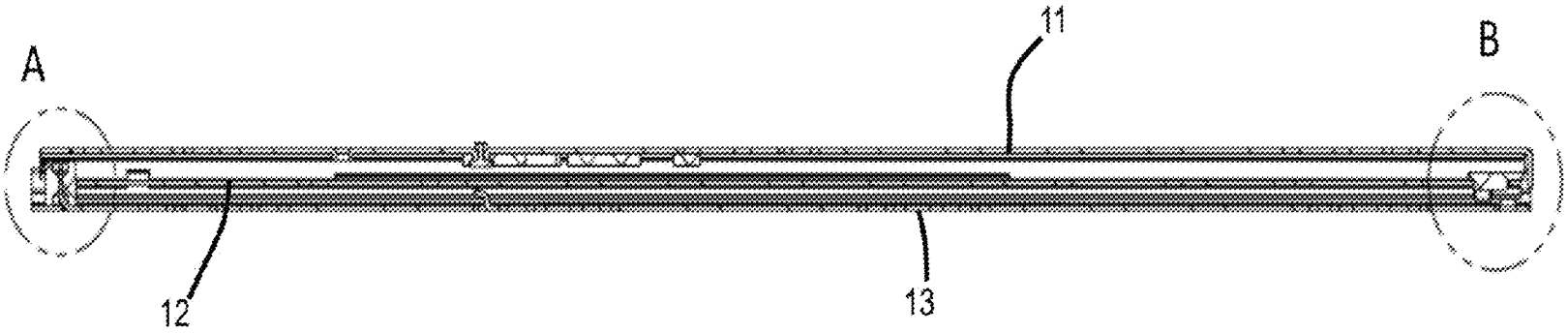
Fig. 3 (Prior Art)
FIG. 3 shows a top view of a longitudinal section of the drawer slider of FIG. 1.
Figure 4:
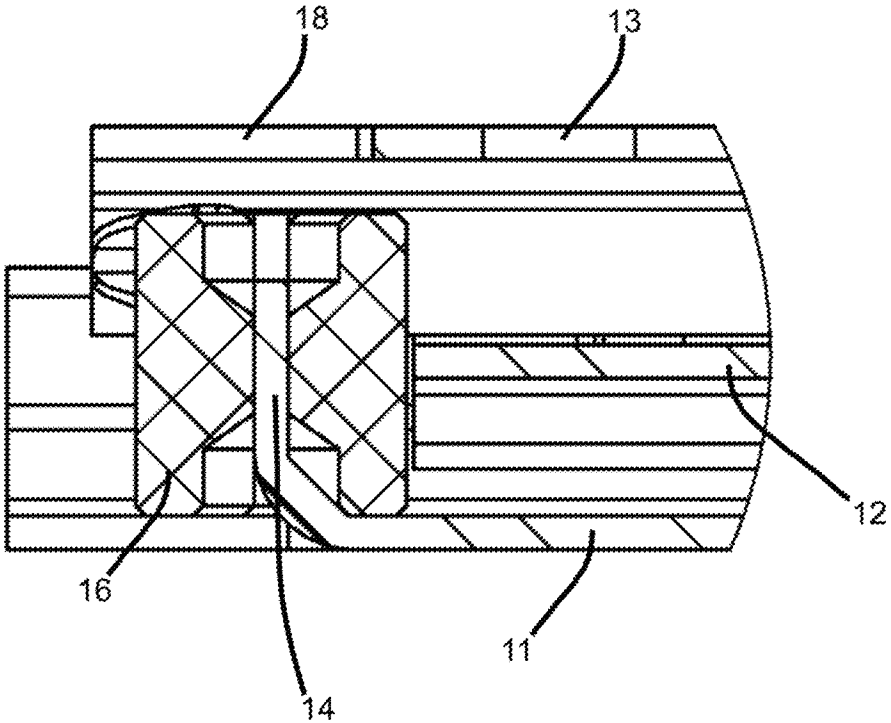
Fig. 4 (Prior Art)
FIG. 4 shows a sectional view of detail A of FIG. 3.

FIGS. 1-5 show a known drawer slider (10), specifically a drawer slider that is commonly referred to as a telescopic drawer slider and includes three rails. Telescopic sliders generally include a first outer rail (11) including a U-shape taken from its cross-section. A second middle rail (12) is mounted on the inside of the first outer rail (11). The second middle rail (12) also generally has a U-shape taken from its cross-section. The inside of the middle rail (12) is provided with a third inner rail (13), that may or may not have a U-shape or any other suitable shape. The third inner rail (13) is mounted on the inside of the second middle rail (12). The rear side of the drawer slider is intended to be attached for example to a wall of a chest of drawers through the outer rail (11), and the front side of the drawer slider, as represented in FIGS. 1 and 2, is intended to be attached to the drawers through the inner rail (13). Thus, both the outer rail (11) and the inner rail (13) may include openings or holes (15, 15') to receive attachment means, such as screws, pins, nails, etc.

The telescopic drawer slider can be also a two-rail telescopic drawer slider, provided with only an outer rail (11) and an inner rail (13). In other words, the drawer slider does not have a middle rail. In the two-rail configuration, the inner rail is directly mounted on and extends along the outer rail. A more detailed description of the two-rail configuration is discussed below.

In operation, the outer rail (11) is attached to the chest and does not slide a drawer, the middle rail (12) moves along the longitudinal plane of the outer rail (11), and the inner rail (13) moves along the longitudinal plane of the middle rail (12), as shown in FIG. 2, which shows the drawer slider in an extended position. In order to allow reciprocal sliding of rails, other elements, for example rollers, pulleys, etc., can be provided in the telescopic drawer slider. Such mechanical elements are not explained or disclosed herein in the Figures, because they are understood by those of ordinary skill in the art.

Figure 5:
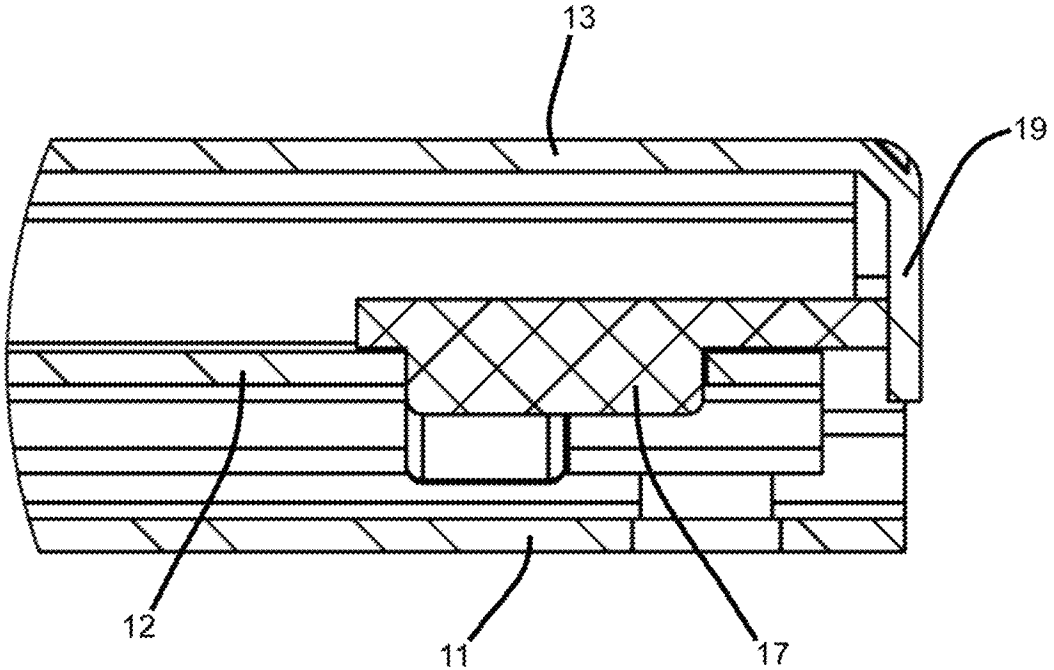
Fig. 5 (Prior Art)
FIG. 5 shows a sectional view of detail B of FIG. 3.

When the drawer slider is extended, as shown in FIG. 2, the stroke of both the middle rail (12) and the inner rail (13) is limited by specific bumpers or pins placed on the inner side of each rail. When the rail is retracted again, the stroke limit of the middle rail (12) is generally limited by a rear bumper (14), provided on one of the sides of the outer rail, in particular on the side opposite to the opening of the rail. In this sense, and as can be observed in detail in FIG. 4, the middle rail (12) lies on the bumper (14), that can be shaped as a fold made on the plate of the outer rail (11) itself, combined or not, to a impact absorption mechanism (16), such as an elastomeric material, such as rubber, and it limits the stroke of the middle rail so that it does not exceed the length of the outer rail (11) that, precisely, defines the stroke limit when the drawer slider is retracted. The inner rail (13) generally has a V-shaped cutout (18) on the same side where the bumper is provided. This cutout has the purpose of lying on and aiding by interference the impact absorption mechanism (16), so that the rail does not move accidentally in the opposite direction, that is, that the opening of the drawer (or the extension of the rail) does not happen without applying force in the opposite direction. In this way, the V-shaped cutout (18) in combination with the impact absorption mechanism (16) prevent the drawer from accidentally opening, for instance, when the chest of drawers is sloped towards the front. When the drawer slider is retracted, the stroke limit of the inner rail (13) is, on the other hand, delimited by another front bumper (17) mounted on the middle rail end (12) and is generally made of a plastic material, and is intended to cooperate with a fold (19) made on the inner rail (13), as shown in FIG. 5.

With regard to FIG. 1, it can be noted that, in known telescopic sliders, the outer rail (11) has an approximately equal length to that of the inner rail (13), while the middle rail (12) may present a shorter or approximately equal length to that of the outer rail (11) and the inner rail (13).

The construction and functioning of a telescopic drawer slider, being of a telescopic drawer slider as the one herein represented in FIGS. 1-5, or a telescopic drawer slider comprising only two rails, is commonly known, and therefore no further details regarding FIGS. 1-5 are provided herein.

FIGS. 6-9 show an embodiment of a drawer slider (20) according to the present disclosure. As opposed to the rails of known telescopic sliders, the inner rail (23) of drawer slider (20) does not have its stroke limited by a rear bumper (14) when the drawer slider (20) is in its retracted position. The inner rail (23) may instead pass over the bumper (14). The stroke limitation of the inner rail is defined by a stroke limiter (24) provided along the longitudinal section of the inner rail (23) itself, and this stroke limiter can cooperate with the bumper (14) so as to, on one hand, allow the stroke limit of the inner rail (23) when it is retracted, and on the other hand, at the same time serve as a mechanism to avoid the accidental opening (or the extension of the drawer slider) in the opposite direction.

Figure 6:
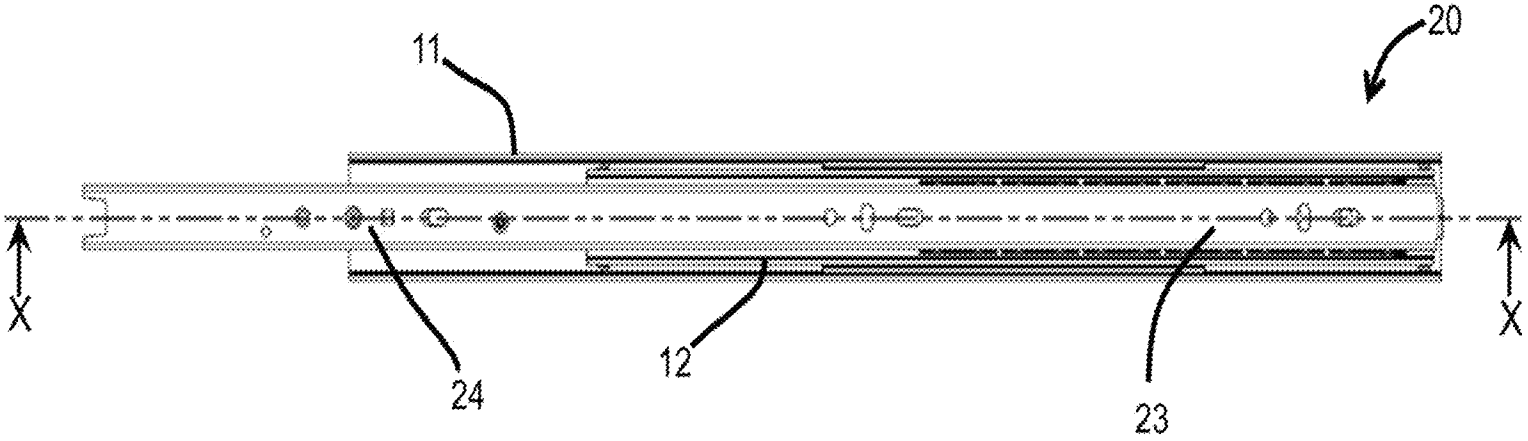
FIG. 6 is a front view of a drawer slider according to an embodiment of the present disclosure, in a retracted position.
Figure 7:
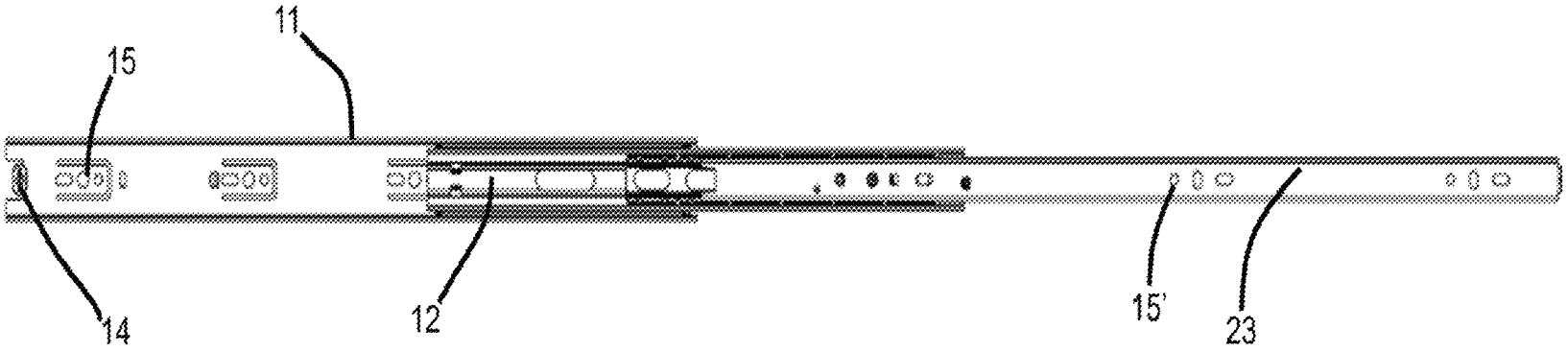
FIG. 7 shows the drawer slider of FIG. 6 in an extended position.
Figure 8:
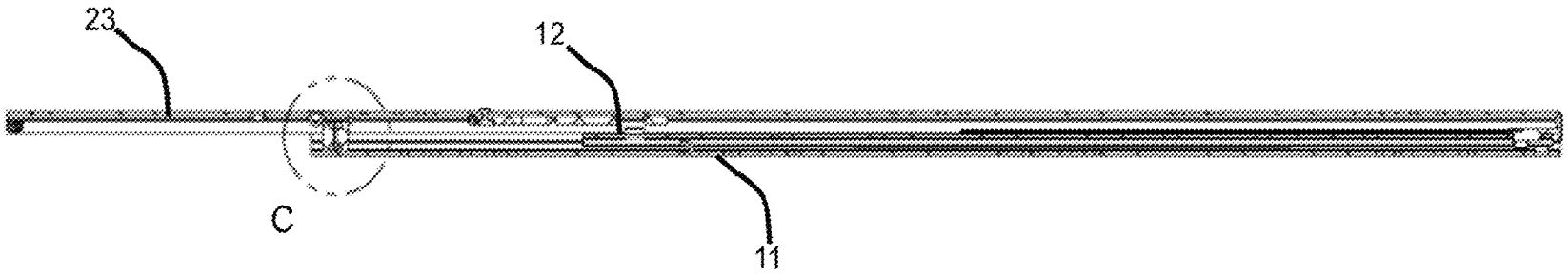
FIG. 8 is a top view along longitudinal X-X section of FIG. 7.

As shown in FIGS. 6 and 8, the inner rail (23) can pass over the longitudinal limits of the outer rail (11) and the middle rail (12), which can be rails equal to known telescopic sliders. Thus, as those of skill in the art will appreciate, it is not a requirement that the stroke limitation of the inner rail be limited only by the frontal bumper (17) cooperating with the fold (18) made on the inner rail (13, 23), but a portion provided along the longitudinal section of the inner rail includes a mechanism (24) for cooperation with the rear bumper (14). The stroke limiter (24) of the inner rail (23) can be, for instance, a fold (25) made along the longitudinal section of the inner rail (23) provided to lay on the stroke limiter (14) provided on the outer rail (11) and, specifically, on the mechanism for impact absorbance (16) of the bumper (14). In this way, the fold (25) made along the longitudinal section of the inner rail allows for the stroke limitation of the inner rail to be limited, when the inner rail is retracted. Consequently, an advantage provided by drawer slider (20), as compared to known sliders, is that the front bumper (17) in known sliders responsible for the stroke limitation of the inner rail (13, 23) may be eliminated.

Figure 9:
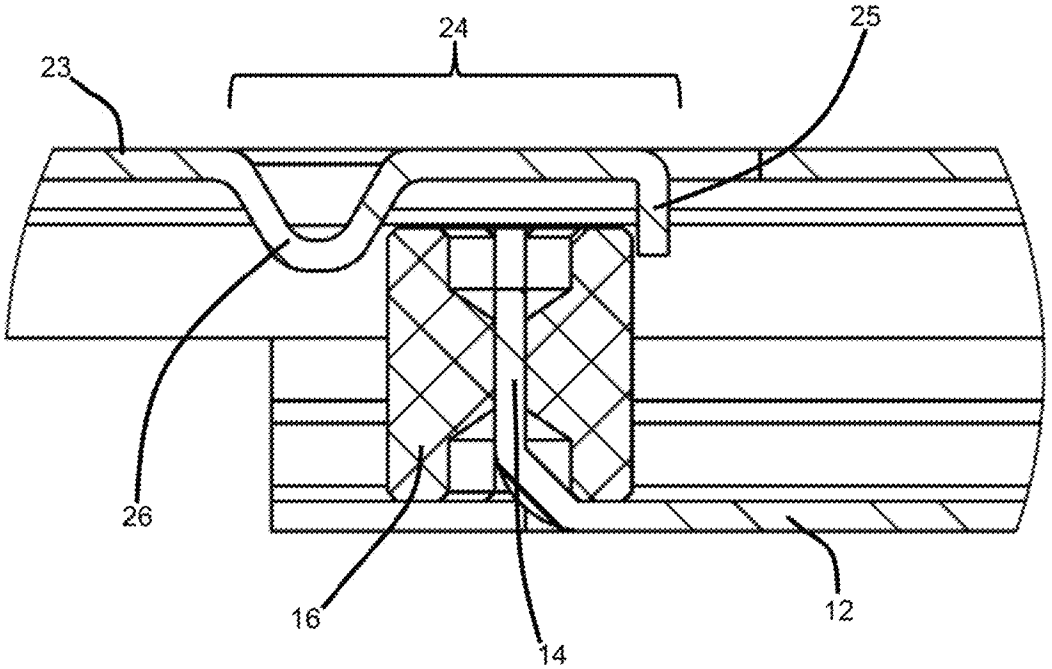
FIG. 9 shows detail C of FIG. 8.

In an embodiment, the stroke limiter (24) additionally includes a punch (26) also intended to cooperate with the impact absorption mechanism (16) of the bumper (14), and positioned at a distance approximately equal to the longitudinal length of the impact absorption mechanism (16) from the fold (25) made with the stroke limiter, as shown in FIG. 9. The punch (26) acts as a mechanism to avoid accidental sliding of the drawer slider in the opposite direction and, in this way, the drawer slider avoids the accidental opening of the drawer or other object requiring a sliding system, since it is placed before the fold (25), having as a reference the longitudinal axis of the inner rail (23) in the closing direction (or retraction). As one of ordinary skill in the art will appreciate, the punch (26) works as a body offering resistance to transpose the bumper (14) associated with the impact absorption mechanism (16), but may have a relatively small area with respect to the bumper (14). The impact absorption mechanism (16) is generally made of elastomeric material, and therefore can pass over the bumper, although offering some resistance both in the closing (retraction) direction of the rail, and of the drawer, and in the opening (extension) direction of the rail, and thus opening of the drawer. Therefore, the punch (26) serves as a mechanism to avoid the accidental opening of the drawer, like the V-shaped cutout (18) that cooperates with the impact absorption mechanism (16) found in known drawer sliders. In this way, an advantage of the present disclosure with respect to known drawer sliders is to eliminate the V-shaped cutout (18), resulting in fewer shaping and cutting operations of the inner drawer slider (23), and also to allow sliders equipped with one or more dampers to be simplified, since the punch (26) partially shows a damping function in the sense of alleviating the impact in the closing direction (retraction) of the drawer slider.

As one of ordinary skill in the art will recognize, despite the stroke limiter (24) being herein defined as a fold (25) made on the inner rail that can be associated with a punch (26), alternatives and equivalents can be provided, for example, without limitation, screws, pins, rivets, etc. Similarly, in an embodiment, the punch (26) provided on the stroke limiter (24) as a mechanism to avoid the accidental opening of the drawer, may be substituted, without any disadvantage, through equivalent means having the same technical effect, for example, without limitation, screws, pins, rivets, etc. Still in particular, the stroke limiter (24) is provided in a specific portion in a spot along the left half of the plane taken with respect to the longitudinal length of the inner rail, considering the orientation of the drawer slider, taken with respect to the Figures shown herein.

An additional advantage of the present disclosure is that it is possible to attain a significant reduction of the length of both the outer and middle rails, without compromising the extension of the drawer slider opening. That is, a drawer slider according to the present disclosure can have an opening extension equal or greater than an equivalent state of the prior art drawer slider, although employing a lower amount of material for its manufacturing, due to the reduction of the length of outer and middle rails. Additionally, since the length of inner rail (23) of the drawer slider according to the present disclosure is not limited, the drawer slider according to the present disclosure can also provide a greater extension of the opening when compared to equivalent known sliders.

Figure 10:
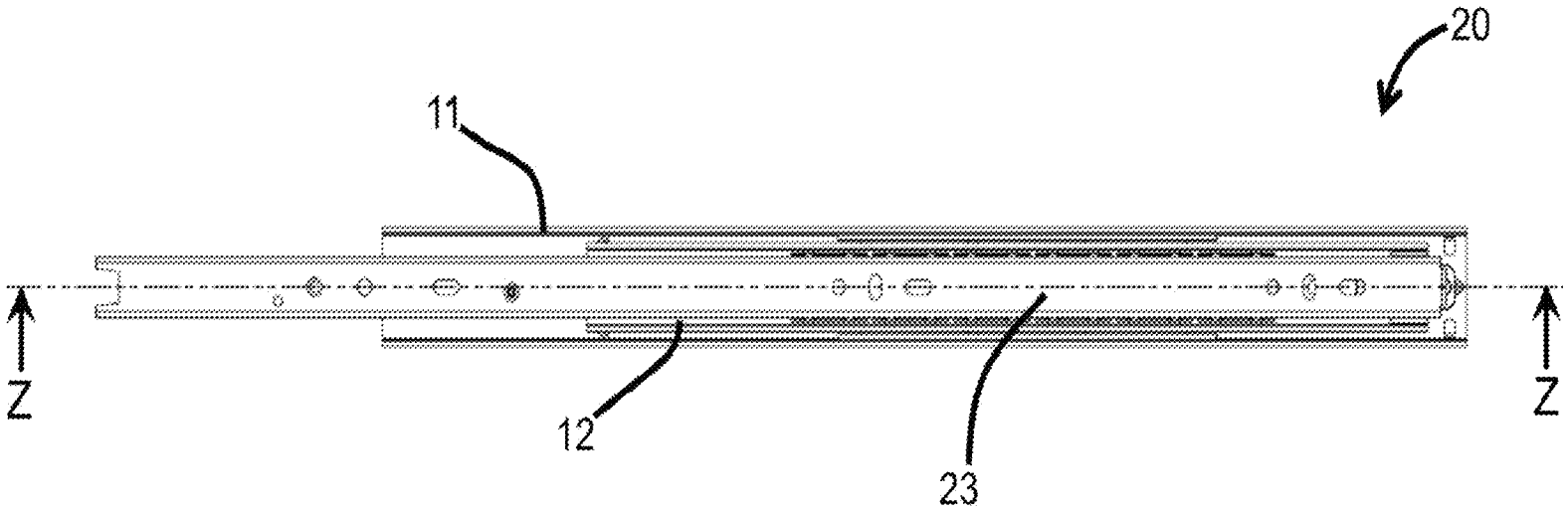
FIG. 10 shows an alternative embodiment of a drawer slider of the present disclosure, in a retracted position.
Figure 11:
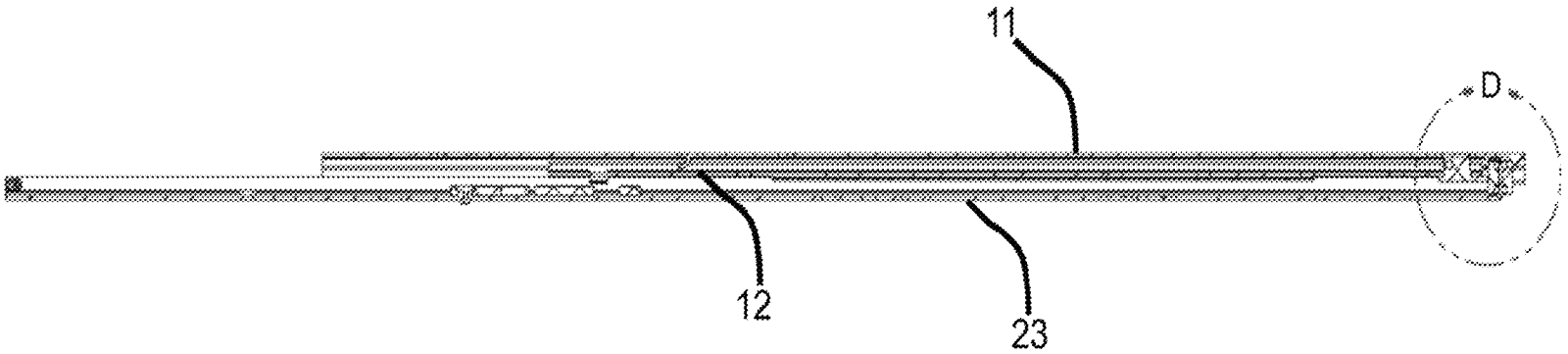
FIG. 11 shows a top view along Z-Z section of FIG. 10.
Figure 12:
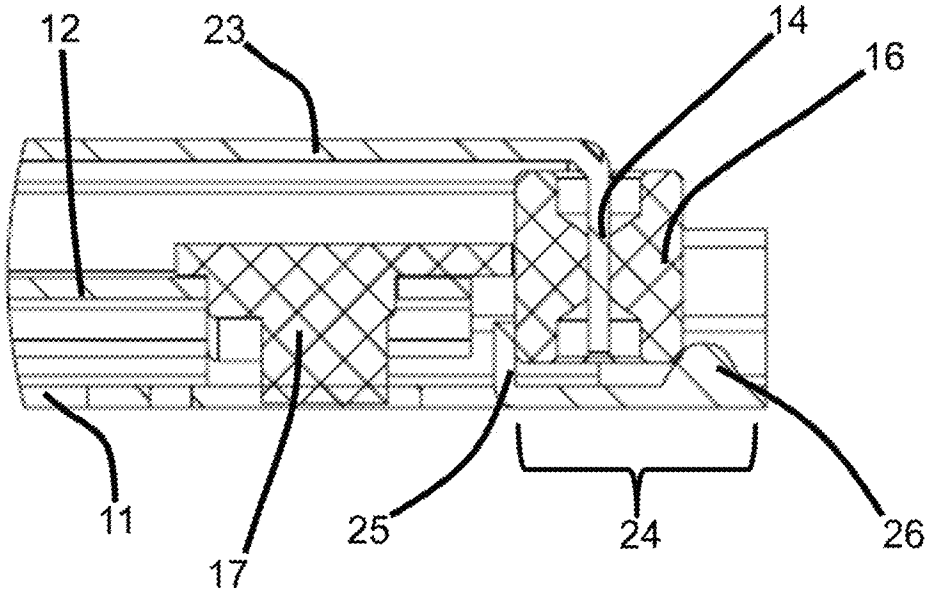
FIG. 12 shows a sectional view of detail D of FIG. 11.
Figure 13:
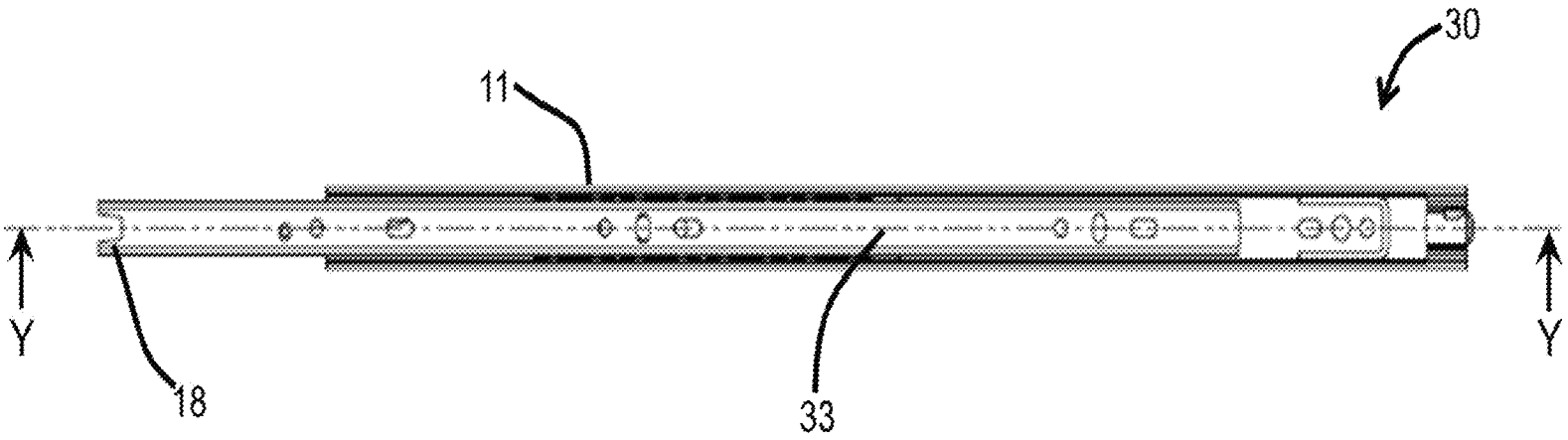
FIG. 13 shows an alternative embodiment of a drawer slider of the present disclosure, for a two-rail telescopic drawer slider, shown in a retracted position.

Another embodiment according to the present disclosure is shown in FIGS. 10-12. In this embodiment, the bumper (14) is not placed on the outer rail (11), but in a frontal portion of the front bumper (23), and the stroke limiter (24) is provided on the outer rail (11), as shown in FIG. 12. In this embodiment, by reversing the disposition of the bumper (14), that can be equally associated with a impact absorption mechanism (16), and of the stroke limiter (24), the functioning of the drawer slider occurs as described above. That is, the bumper may cooperate with the stroke limiter, that also can be presented as a fold (25) made on the plate of the outer rail, eventually associated with a punch (26) that can work as a mechanism to avoid accidental sliding of the drawer slider.

Another embodiment according to the present disclosure is shown in FIGS. 13-17. In this embodiment, the drawer slider is a two-rail telescopic drawer slider (30), that is, there is no middle rail and the drawer slider includes only an outer rail (11) and an inner rail (33) mounted on the outer rail that is intended to slide a drawer along the longitudinal plane of the outer rail (11). As with three-rail telescopic sliders, to allow reciprocal sliding of the rails, it is possible that other elements, like rollers, pulleys, etc., may also be provided, such as specific bumpers or pins provided on the inside of each rail to limit the stroke of the inner rail (33) when the drawer slider is extended. These elements are already known by those skilled in the art and therefore are not specifically described herein.

Known two-rail sliders also include a bumper (14) associated with an impact absorption mechanism (16) provided on the outer rail (11) to cooperate with a V-shaped cutout (18) provided on the inner rail (33), having the same function provided for the three-rail telescopic drawer slider and, thus, no further explications are given herein. The stroke limitation of the inner rail (33) when the drawer slider is in its retracted position is such as for three-rail telescopic sliders, defined by a fold provided on the inner rail (33) that cooperates with a front bumper (not represented), although directly provided on the outer rail (33), instead of being provided on the middle rail that, in this case, does not exist.

In the two-rail drawer slider of the present disclosure, the stroke limiter of the inner rail (33) is provided along its longitudinal section, as described above for three-rail telescopic sliders. This mechanism can also, instead of being built directly on the inner rail (33) with a fold or a punch, be associated with a clamp (40) that is mounted along the longitudinal section of the inner rail (33) and provided to cooperate with the rear bumper (14) associated with the impact absorption mechanism (16).

Figure 14:
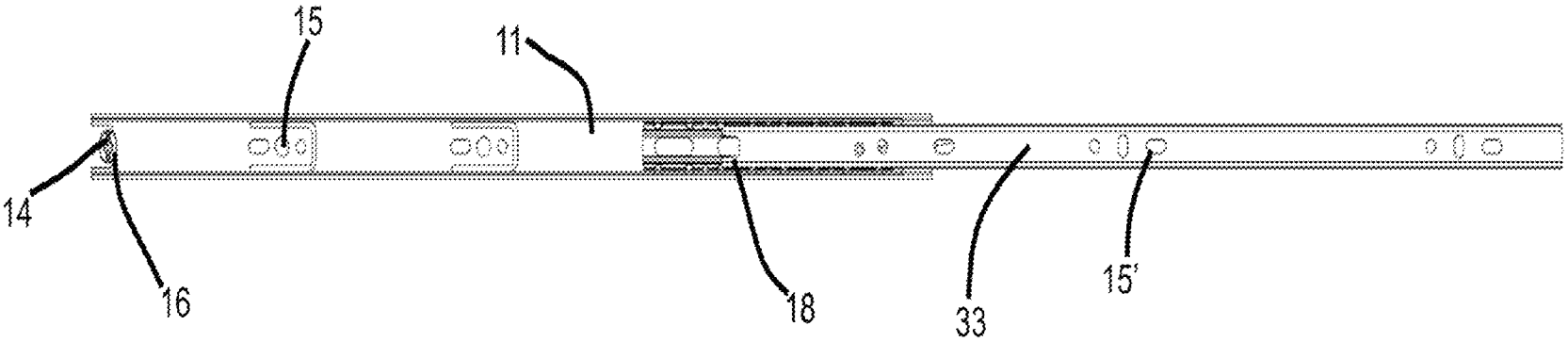
FIG. 14 shows the drawer slider of FIG. 10 in an extended position.
Figure 15:
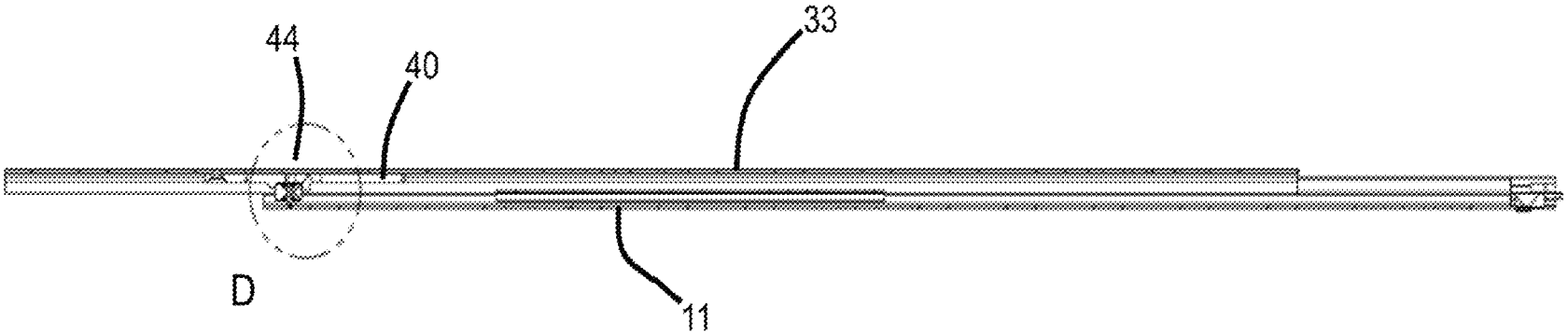
FIG. 15 shows a top view along the longitudinal Y-Y section of FIG. 10.
Figure 16:
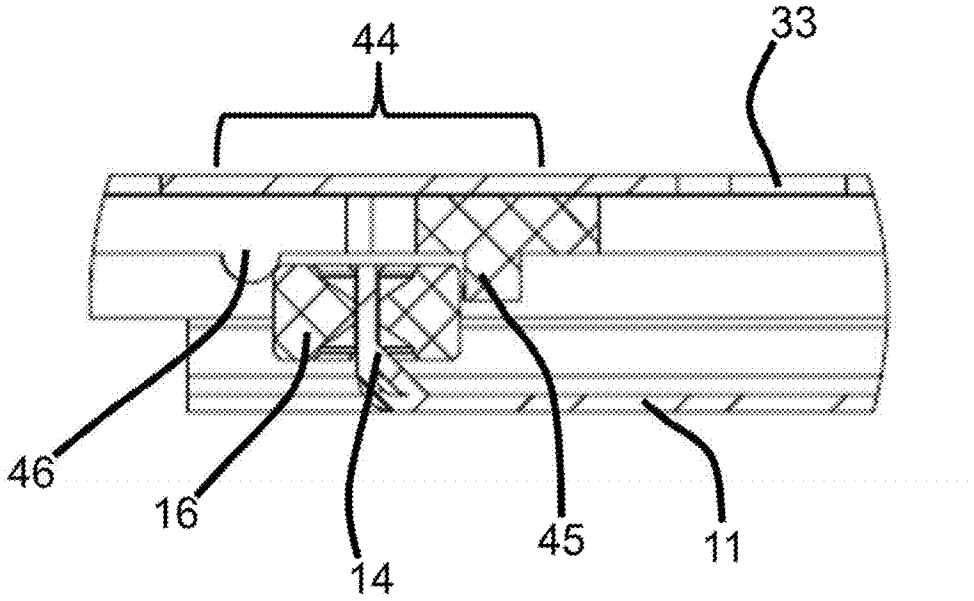
FIG. 16 shows detail D of FIG. 12.

Two-rail sliders generally comprise a clamp (40) that is attached to the inner rail (33) and has the function to avoid the easy removal thereof when the drawer slider is extended. In other words, the clamp, as shown in FIG. 14, is abutted by means of its circular opening in the inner rail (33) and includes two loops in a suitable shape to create a resistance to the total removal of the inner rail (33). In other words, this clamp, that can assume different configurations for different kinds of sliders, prevents the outer rail (33) from being removed when the drawer slider is extended, and also acts as a stroke limiter of the inner rail when the drawer slider is extended.

In an embodiment, the clamp can comprise the stroke limiter provided to cooperate with the bumper (14) associated with the impact absorption mechanism (16) of the outer rail (11). With reference to FIGS. 13-17, the stroke limiter can comprise a first projection (45) made in the clamp itself, provided for lying on the stroke limiter (14) provided on the outer rail (11) and, in particular, in the impact absorption mechanism (16) of the bumper (14). In this way, the projection (45) provided in the clamp and arranged along the longitudinal section of the inner rail (11) allows for the stroke limitation of the inner rail to be limited when it is retracted. Consequently, as in the embodiment described for three-rail telescopic sliders, an advantage of the present disclosure is to allow the front bumper of stroke limitation of the inner rail to be eliminated.

Figure 17:
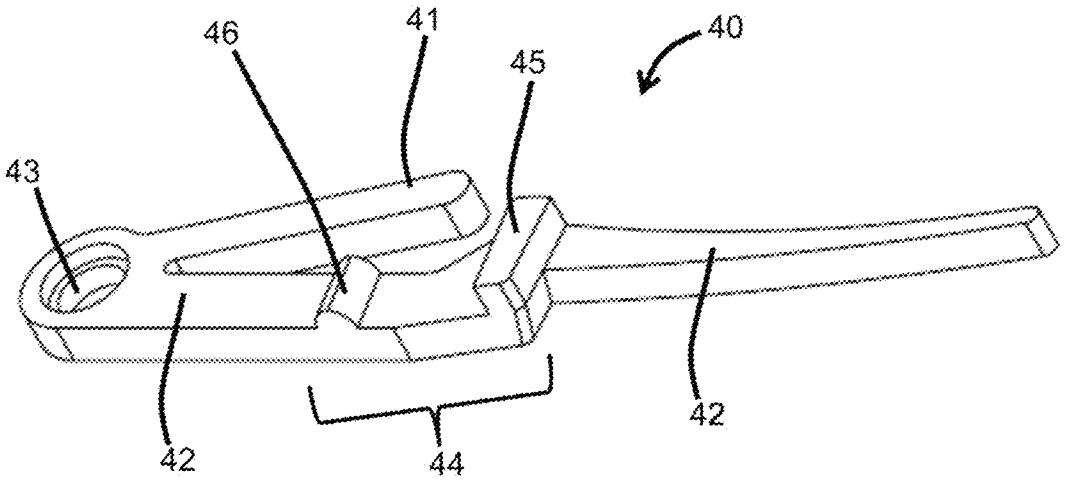
FIG. 17 is a perspective view of a clam of a two-rail telescopic drawer slider that may be used as stroke limiter.

In particular, according to an additional embodiment of the disclosure pursuant to this embodiment, the stroke limiter (44) additionally includes a second projection (46) provided in the clamp itself, and that may comprise a lesser height and width than the first projection (45). This second projection is also configured to cooperate with the impact absorption mechanism (16) of the bumper (14) and positioned at a distance that is approximately equal to the longitudinal length of the impact absorption mechanism (16) with respect to the first projection (45) formed on the clamp as a stroke limiter, as shown in FIG. 17. The second projection (46) serves as a mechanism to avoid accidental sliding of the inner rail (33) in the opposite direction and, therefore, to avoid the accidental opening of the drawer, since it is placed before the first projection (45), having as a reference the longitudinal plane of the inner rail (33) in the closing (or retraction) direction. As one of ordinary skill in the art can appreciate, the second projection, such as the punch (26) discussed with respect to the earlier embodiment described herein, works as a body offering resistance to transpose the bumper (14) associated with the impact absorption mechanism (16), although, on the other hand, it can have a relatively lower height and smaller area than the first projection and the bumper (14), and considering that the impact absorption mechanism (16) is, generally, made in elastomeric material, it can transpose over the bumper, although offering some resistance, both in the closing (retraction) direction of the rail, and thus of the drawer, and in the opening (extension) direction of the rail, and thus opening of the drawer. Therefore, the second projection (46) serves as a mechanism to avoid the accidental opening of the drawer, such as the V-shaped cutout (18) that cooperates with the impact absorption mechanism (16) found in known sliders. As discussed earlier, an advantage of this embodiment with respect to known sliders is that the V-shaped cutout (18) can be eliminated, resulting in fewer shaping and cutting operations of the inner drawer slider (23).

The drawer slider may be made of any suitable material already known for the construction of a drawer slider, for example carbon steel, and subsequently the drawer slider may or may not receive protective paint, or superficial topcoat. It is also possible to utilize other materials, such as stainless steel or polymeric materials. The other components, such as bumpers, stroke limiters, locks, impact absorption mechanisms, etc. can be made of any suitable material, for example, polymeric and/or elastomeric materials.

It is also possible to significantly reduce the material utilized for the shaping of the rails. This reduction of material employment results in considerable savings in the cost of the final product, since the material cost, as discussed above, may be up to ⅔ of the total cost of the finished product.

It is also possible, in only one assembly step, to produce more rails with the same blank size, because the outer and middle rails have a reduced length. This also results in productivity increases, which results in a reduction of the cost of the finished product.

It shall be acknowledged that, although the present disclosure has been described with respect to particular embodiments, a person skilled in the art may develop a wide variation of structural and/or operational details and extend the above-described disclosure to other kinds of applications without deviating from the principles described herein. Hence, the accompanying claims shall be interpreted as covering all the equivalents falling into the scope and character of the present disclosure.

The invention claimed is:

1. A drawer slider comprising:

a fixed outer rail including a bumper provided on or near an edge of the outer rail along a longitudinal plane of the outer rail; and at least one inner rail mounted on the outer rail that can move longitudinally along the outer rail, the inner rail including a stroke limiter along a longitudinal section of the inner rail that is configured to cooperate with the bumper, the stroke limiter including a mechanism to avoid accidental sliding, wherein the inner rail has a longitudinal length that is longer than a longitudinal length of the outer rail.

2. The drawer slider according to claim 1, which includes a middle rail mounted on the outer rail and configured to move longitudinally along the outer rail, wherein the inner rail is mounted on the middle rail and can move longitudinally along the middle rail.

3. The drawer slider according to claim 1, which includes a metallic material.

4. The drawer slider according to claim 3, wherein the metallic material is carbon steel.

5. The drawer slider according to claim 1, wherein the stroke limiter includes a fold along the longitudinal section of the inner rail that is configured to cooperate with the bumper.

6. The drawer slider according to claim 1, wherein the stroke limiter is provided in a defined portion along half of the plane taken with respect to the longitudinal length of the inner rail or the outer rail.

7. The drawer slider according to claim 1, wherein the mechanism to avoid accidental sliding is a punch configured to cooperate with the stroke limiter.

8. The drawer slider according to claim 1, wherein the stroke limiter is provided in a clamp that is mounted on the inner rail.

9. The drawer slider according to claim 8, wherein the stroke limiter provided in the clamp is includes a first projection configured to cooperate with the bumper.

10. The drawer slider according to claim 9, wherein the mechanism to avoid accidental sliding is a second projection configured to cooperate with the bumper.

11. The drawer slider according to claim 1, wherein the stroke limiter includes an impact absorption mechanism.

12. The drawer slider according to claim 11, wherein the impact absorption mechanism includes an elastomeric material.

13. The drawer slider according to claim 1, wherein the stroke limiter includes a first projection to provide a stroke limit for the inner rail and a second projection to avoid accidental sliding, the first projection and the second projection each projecting from the inner rail towards the outer rail, the bumper maintained between the first projection and the second projection when the drawer slider is closed.

14. The drawer slider according to claim 13, wherein the second projection is configured to transpose over the bumper when the drawer slider is opened and closed.

15. A drawer slider comprising:

a fixed outer rail including a stroke limiter provided along a longitudinal section of the outer rail; and at least one inner rail mounted on the outer rail that can move longitudinally along the outer rail, the inner rail including a bumper provided on or near an edge taken along a longitudinal plane of the inner rail that is configured to cooperate with the stroke limiter, the stroke limiter including a mechanism to avoid accidental sliding, wherein the inner rail has a longitudinal length that is longer than a longitudinal length of the outer rail.

16. The drawer slider according to claim 15, wherein the stroke limiter includes a fold along the longitudinal section of the outer rail that is configured to cooperate with the bumper.

17. The drawer slider according to claim 15, which includes a middle rail mounted on the outer rail that can travel longitudinally along the outer rail, wherein the inner rail is mounted on the middle rail and can travel longitudinally along the middle rail.

18. The drawer slider according to claim 15, wherein the mechanism to avoid accidental sliding is a punch configured to cooperate with the stroke limiter.

19. The drawer slider according to claim 15, wherein the stroke limiter includes a first projection to provide a stroke limit for the inner rail and a second projection to avoid accidental sliding, the first projection and the second projection each projecting from the outer rail towards the inner rail, the bumper maintained between the first projection and the second projection when the drawer slider is closed.

20. The drawer slider according to claim 19, wherein the second projection is configured to transpose over the bumper when the drawer slider is opened and closed.

* * * * *